US012551767B1

(12) United States Patent
Voves et al.

(10) Patent No.: US 12,551,767 B1
(45) Date of Patent: Feb. 17, 2026

(54) TARGET ASSEMBLY FOR PROJECTILE SHOOTING PRACTICE

(71) Applicant: Hyperstrike Hockey, LLC, Onalaska, WI (US)

(72) Inventors: Jeffrey David Voves, Onalaska, WI (US); Greg Allen White, Lino Lakes, MN (US)

(73) Assignee: Hyperstrike Hockey, LLC, Onalaska, WI (US)

( * ) Notice: Subject to any disclaimer, the term of this patent is extended or adjusted under 35 U.S.C. 154(b) by 624 days.

(21) Appl. No.: 17/900,180

(22) Filed: Aug. 31, 2022

Related U.S. Application Data

(60) Provisional application No. 63/239,500, filed on Sep. 1, 2021.

(51) Int. Cl.
*A63B 69/00* (2006.01)
*A63B 63/00* (2006.01)
*A63B 63/06* (2006.01)

(52) U.S. Cl.
CPC ..... *A63B 63/004* (2013.01); *A63B 63/06* (2013.01); *A63B 69/0024* (2013.01); *A63B 2210/50* (2013.01)

(58) Field of Classification Search
CPC ... A63B 63/004; A63B 63/06; A63B 69/0024; A63B 2210/50
USPC ..... 473/446, 478
See application file for complete search history.

(56) References Cited

U.S. PATENT DOCUMENTS 4,842,283 A * 6/1989 LeBel ..... A63B 63/004 473/478
5,238,243 A * 8/1993 Grispi ..... A63B 63/00 473/446
7,252,604 B2 * 8/2007 Birss ..... A63B 63/003 473/446
7,950,666 B2 * 5/2011 Stincelli ..... F41J 7/04 273/386
9,457,249 B2 * 10/2016 Goldberg ..... A63B 63/004 473/446

* cited by examiner

*Primary Examiner* — Mitra Aryanpour
(74) *Attorney, Agent, or Firm* — Craig Fieschko; DeWitt LLP

(57) ABSTRACT

A projectile target assembly includes one or more latching target subassemblies and a reset target subassembly, with each subassembly bearing a target at which projectiles may be shot. Striking a target on any of the subassemblies moves it from an extended position to a retracted position, and striking the target of the reset target subassembly actuates any retracted targets of the latching target subassemblies to move back to their ready-to-shoot extended positions. A shooter can therefore reset the targets of the latching target subassemblies by simply shooting at (and hitting) the target of the reset target subassembly, without the need to travel from the shooter's shooting location to the projectile target assembly to reset the targets into their ready-to-shoot extended positions.

23 Claims, 13 Drawing Sheets

10
204
422
352
400
428
406
426
404
416
408
402
410

TARGET ASSEMBLY FOR PROJECTILE SHOOTING PRACTICE

FIELD OF THE INVENTION

This document concerns an invention relating generally to targets for projectile shooting practice, and more specifically to projectile targets which are foldable or otherwise retractable upon being struck, and are thereafter extensible or otherwise resettable for reuse.

BACKGROUND OF THE INVENTION

Many recreational and sporting activities involve accurate shooting of projectiles. As examples, hockey relies on accurate shooting of a puck; baseball and football rely on accurate shooting (throwing) of a ball; soccer relies on accurate shooting (kicking) of a ball; archery relies on accurate shooting of an arrow; and riflery relies on accurate shooting of a bullet. Reusable targets are often used for shooting practice, with the targets being placed at desired locations and then being shot at, but these can be annoying to use because the user must repeatedly walk between the shooting and target locations to reset the targets after they've been hit. To illustrate, hockey shooting practice sometimes relies on targets set on the ground in front of a hockey goal which are knocked out of place when hit by pucks, or targets hung on the struts of the goal which are knocked down when struck. After striking the targets, the user must skate from the shooting location to the goal to manually reset the targets, a chore which detracts from the time spent on, and the enjoyment of, shooting practice.

SUMMARY OF THE INVENTION

The invention involves a projectile target assembly which is intended to at least partially solve the aforementioned problems. To give the reader a basic understanding of some of the advantageous features of the invention, following is a brief summary of an exemplary version of the projectile target assembly, with reference being made to the accompanying drawings (which are briefly reviewed in the following "Brief Description of the Drawings" section of this document) to assist the reader's understanding. Since the following discussion is merely a summary, it should be understood that more details regarding the exemplary version may be found in the Detailed Description set forth elsewhere in this document. The claims set forth at the end of this document then define the various versions of the invention in which exclusive rights are secured.

FIG. 1*a* illustrates an exemplary projectile target assembly 100 installed on a hockey goal (shown without a net installed), with FIG. 1*b* showing the assembly 100 removed from the goal 10. The assembly 100 includes a assembly frame 200 having a frame arch 202 which fits about the front arch 12 of the goal 10 and which bears several latching targets 302, and a frame leg 204 which extends toward and affixes to the rear support post 14 of the goal 10, and which bears a reset target 402. All targets 302 and 402 are shown in extended positions allowing their use as shooting targets. A hockey player can shoot pucks at the latching targets 302, and if a latching target 302 is struck, it will fold rearwardly (and latch) into a retracted position. Striking the reset target 402 at any time will unlatch any retracted latching targets 302 and return them to their extended positions. A shooter therefore need not repeatedly approach the goal 10 to "reset" targets 302 and 402 into ready-to-shoot positions after striking one or more targets, and the semi-automatic operation of the projectile target assembly 100—wherein the latching targets 302 are restored to their ready-to-shoot extended positions by striking the reset target 402—tends to enhance the shooter's interest and motivation during shooting practice.

FIGS. 2*a*-2*g* then illustrate one of the latching targets 302, more particularly, a latching target subassembly 300 which provides the aforementioned latching feature. Looking particularly to FIGS. 2*b* and 2*d*-2*g*, which show the latching target subassembly 300 removed from the assembly frame 200, the latching target 302 is situated on a latching target arm 304 which pivots with respect to a latching target anchor 306 (collectively items 308, 310, and 312, which connect to the assembly frame 200) to move the latching target 302 between its extended latching target position (seen in FIGS. 2*b* and 2*d*) and its retracted latching target position (seen in FIGS. 2*f* and 2*g*). The latching target 302, more particularly its latching target arm 304, bears a latch 314 which travels along a latch travel path when the latching target 302 moves between the extended and retracted latching target positions. Looking particularly to FIGS. 2*d*-2*f*, a catch 316 movably connected to the latching target anchor 306 is elastically biased (via catch spring 318) into the latch travel path, and as the latch 314 travels along the latch travel path from the extended latching target position of FIG. 2*d* to the retracted latching target position of FIG. 2*f*, the latch 314 engages the catch 316 to retain the latching target 302 in the retracted latching target position. An unlatching member 320, here provided as a cable, is connected to the catch 316, wherein pulling the unlatching member 320 from the latching target anchor 306 (as illustrated in FIGS. 2*f* and 2*g*) moves the catch 316 from the latch travel path, thereby disengaging the latch 314 from the catch 316. Upon disengagement of the latch 314, the latching target 302 can return to its extended latching target position (here via gravity and/or via a biasing force exerted by a latching target spring 322 situated between the latching target anchor 306 and the latching target arm 304).

The pulling of the unlatching member 320 is performed by the retraction of the reset target 402, which is provided in the reset target subassembly 400 shown in greater detail in FIGS. 3*a*-3*d*. The reset target subassembly 400 includes a reset target anchor 404 which is affixed to the assembly frame 200 (and to the rear goal support post 14 via reset target clamp 406), and a reset target arm 408 which bears the reset target 402 and which pivots with respect to the reset target anchor 404 to carry the reset target 402 between its extended reset target position (FIG. 3*c*) and its retracted reset target position (FIG. 3*d*). The unlatching member 320 extends along the assembly frame 200 from the latching target subassembly 300 to the reset target 402 (more particularly, to its reset target arm 408). Pivoting the reset target 402 from the extended reset target position of FIG. 3*c* toward the retracted reset target position of FIG. 3*d* pulls the unlatching member 320 away from the latching target subassembly 300, thereby urging the catch 316 of the latching target subassembly 300 from the latch travel path and disengaging the latch 314 from the catch 316 (as in FIGS. 2*f* and 2*g*), allowing the latching target 302 to return to its extended latching target position. The reset target subassembly 400 of FIGS. 3*a*-3*d* receives the unlatching members 320 of each of the latching targets 302 of FIGS. 1*a*-1*b*, and thus striking the reset target 402 into its retracted position will reset all latching targets 302 that are not already in the extended latching target position into such position.

Further potential advantages, features, and objectives of the invention will be apparent from the remainder of this document in conjunction with the associated drawings.

BRIEF DESCRIPTION OF THE DRAWINGS

FIG. 2*g* depicts the latching target subassembly 300 of FIG. 2*f* at the moment the catch 316 is withdrawn from the latch 314, with the latching target 302 being about to return to its extended latching target position (as in FIGS. 2*a*-2*d*) via the latching target spring 322 and/or via the force of gravity.

DETAILED DESCRIPTION OF EXEMPLARY VERSIONS OF THE INVENTION

Figure 1A:
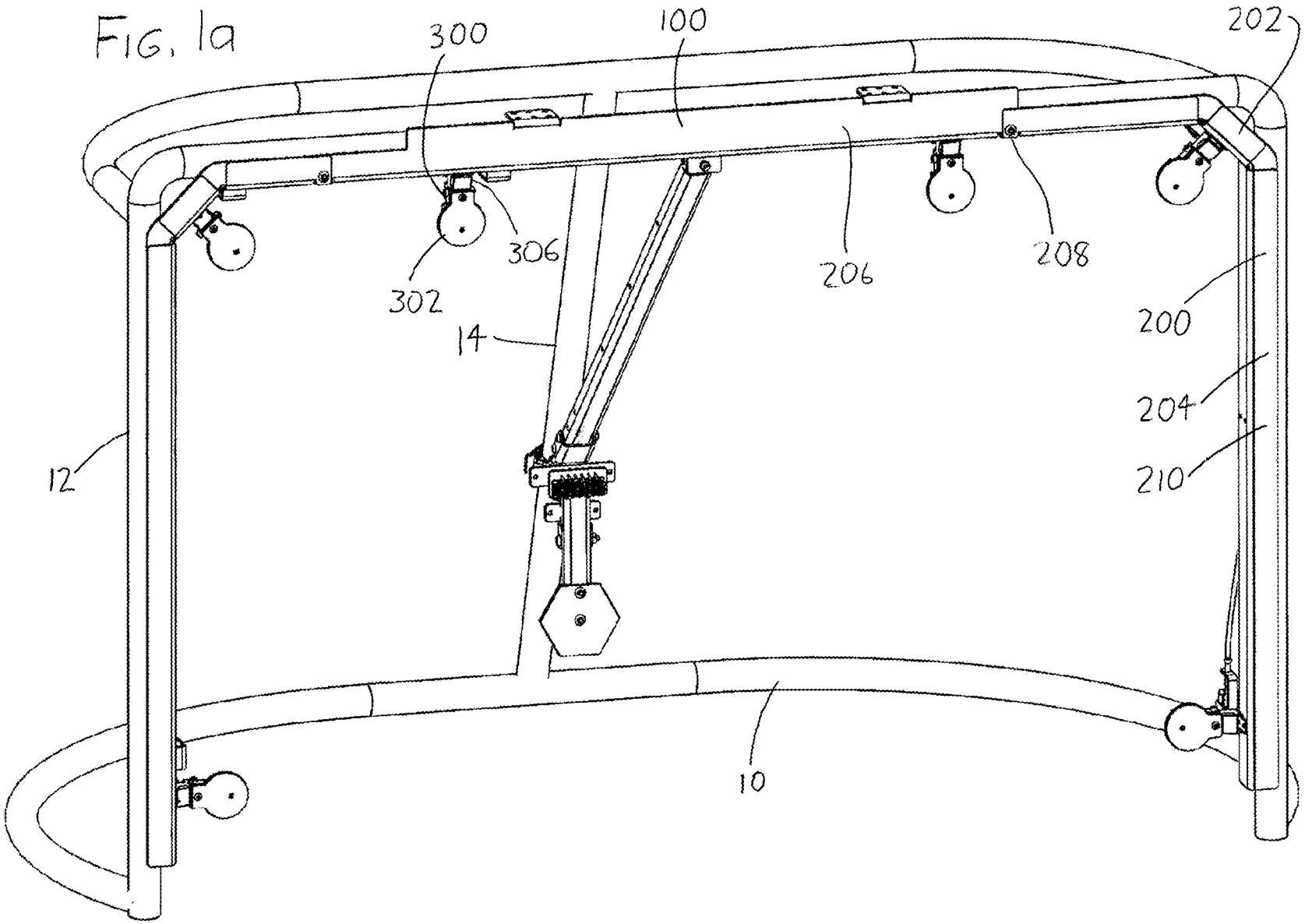
FIG. 1*a* depicts a projectile target assembly 100 exemplifying the invention, shown installed in a ready-to-use state on a hockey goal 10 (which is shown without a net).

Expanding on the discussion above, looking to FIG. 1*a*, the assembly frame 200 of the projectile target assembly 100 is articulated, with its frame arch 202 and frame leg 204 folding for easier transport and storage of the projectile target assembly 100. More particularly, the frame arch 202 includes a frame central section 206 connected by frame arch pivots 208 to opposing frame side lengths 210, such that the frame side lengths 210 can pivot upwardly (when oriented as in FIG. 1*a*) until their major lengths are in abutment. The frame leg 204 is similarly pivotally connected to the frame central section 206 such that it can fold into abutment with the folded frame side lengths 210.

Figure 1B:
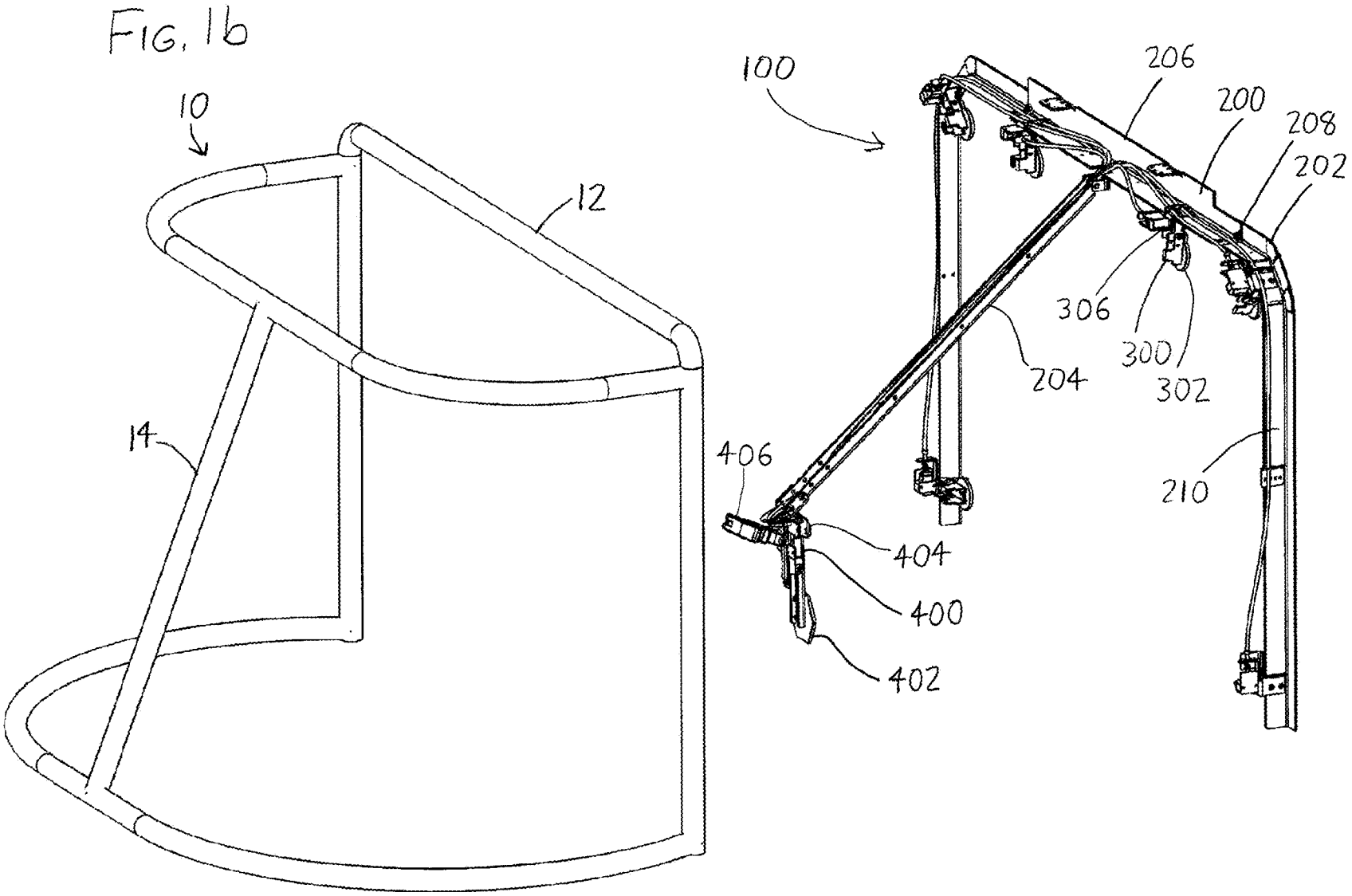
FIG. 1*b* depicts the exemplary projectile target assembly 100 shown removed from the hockey goal 10.

The frame central section 206, frame side lengths 210, and frame leg 204 are preferably formed of lengths of sheet material (e.g., steel plate), bent along their lengths into channels having L-shaped cross-sections (see FIG. 1*b*), and preferably bear fastener apertures (or other fastening means) spaced along their lengths such that the latching target subassemblies 300 can be connected at desired locations along the frame arch 202 (with appropriate adjustments in the lengths of their unlatching members 320). The frame leg 204 is preferably formed of a length of channel having a U-shaped cross-section, whereby the unlatching members 320 extend from the reset target subassembly 400 through the U-channel of the frame leg 204, and then within the L-channels of the frame central section 206 and the frame side lengths 210, to the latching target 302 assemblies situated about the front arch 12.

Figure 2A:
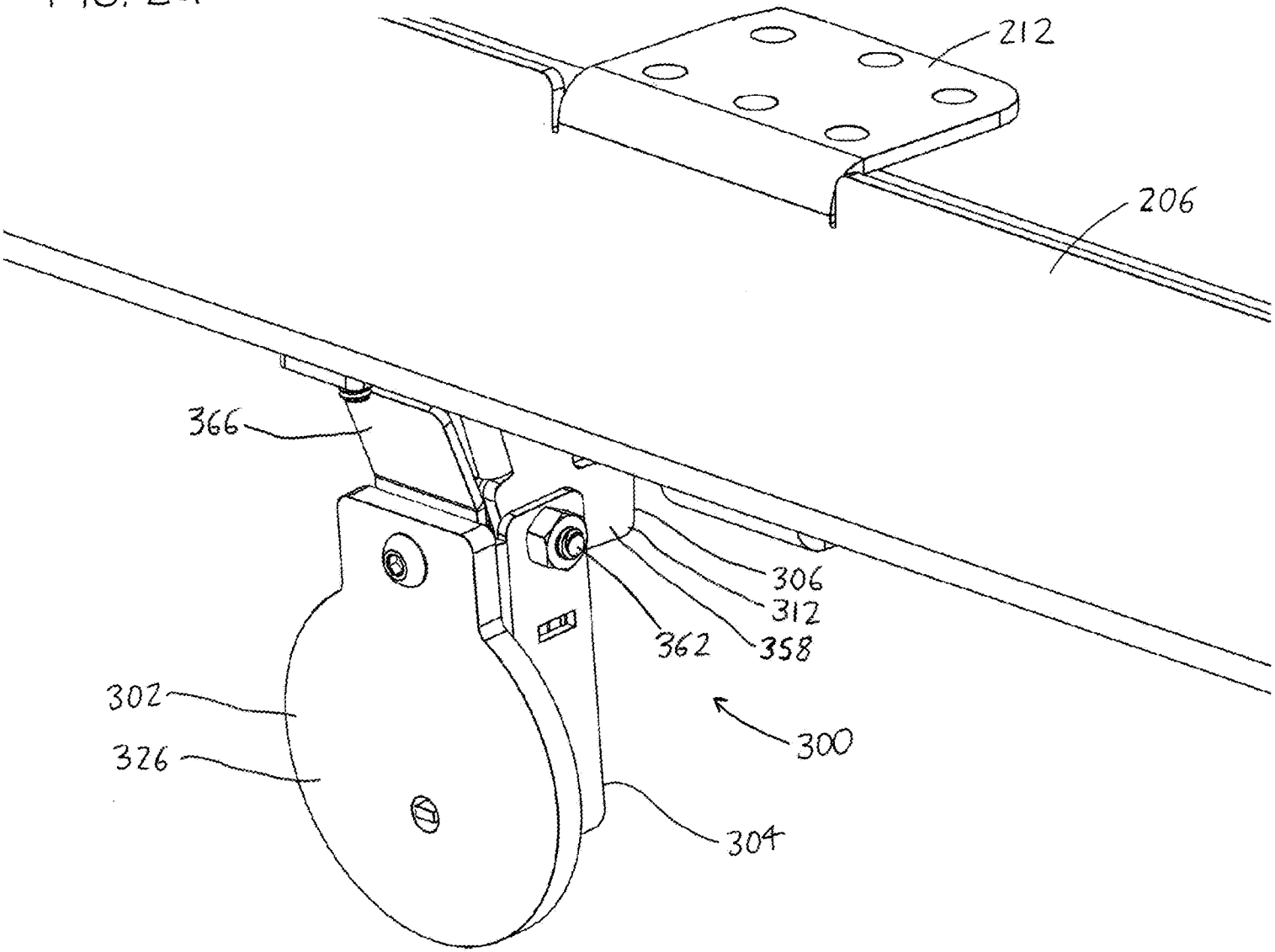
FIG. 2*a* depicts one of the latching target subassemblies 300 of FIGS. 1*a*-1*b* in greater detail (in particular, the first latching target subassembly 300 shown in FIG. 1*a* on the frame central section 206 to the left of the frame leg 204).

The assembly frame 200 fits to the goal 10 via latching target clamps 212 and a reset target clamp 406 which grasp and retain the goal front arch 12 and goal rear support post 14. The latching target clamps 212 on the frame arch 202 (FIGS. 1*b* and 2*a*) are here provided on the frame central section 206, with these latching target clamps 212 being defined by pairs of opposing ears whereby the goal front arch 12 may be fit between the ears of each pair and fastened therein via fasteners, straps, or other closures extending between the ears. The reset target clamp 406 on the frame leg 204 (FIGS. 1*b* and 3*a*-3*g*) is defined by jaws which may be opened and closed about the goal rear support post 14.

Figure 2B:
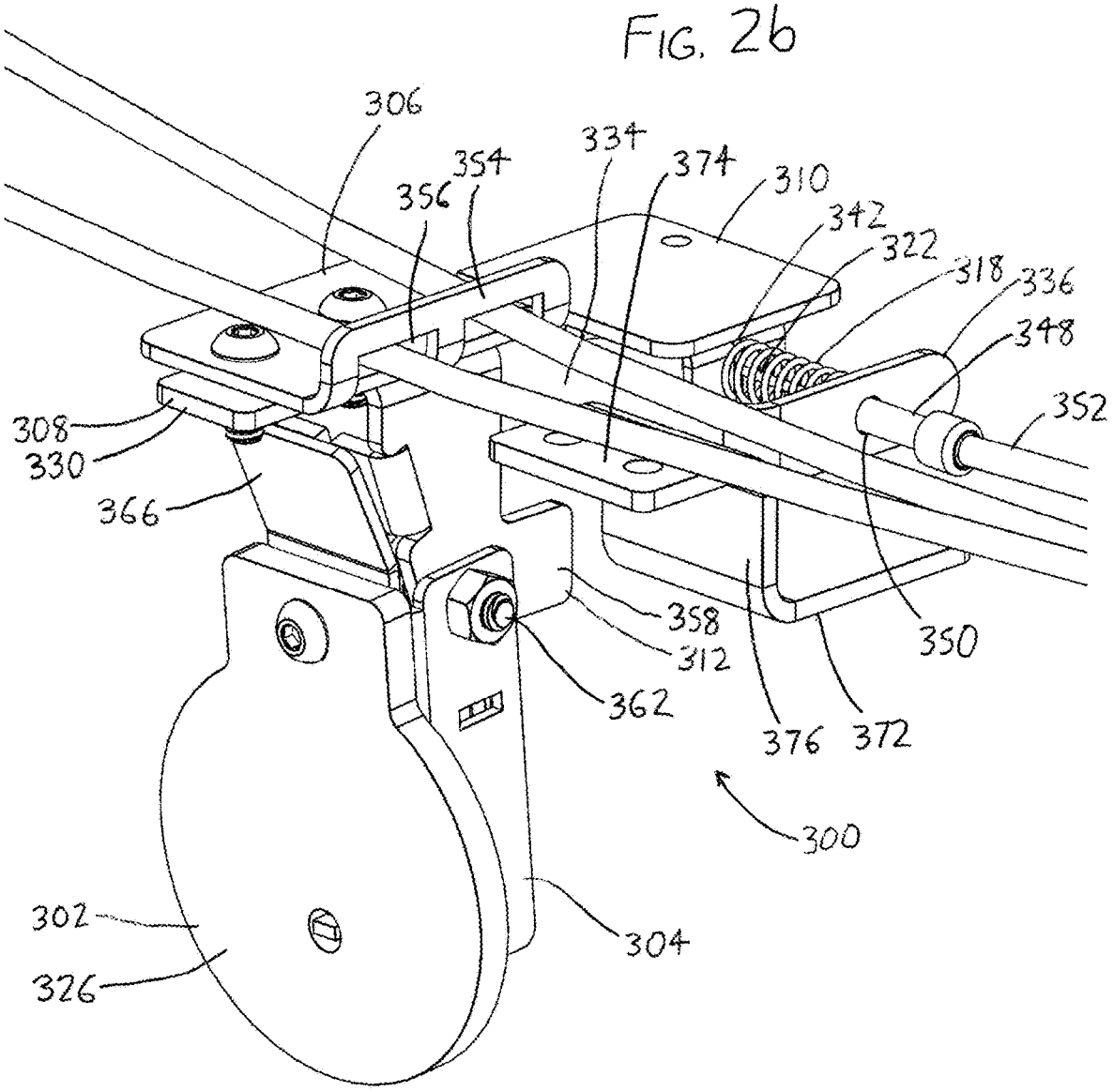
FIG. 2*b* depicts the latching target subassembly 300 of FIG. 2*a* without the frame central section 206.
Figure 2C:
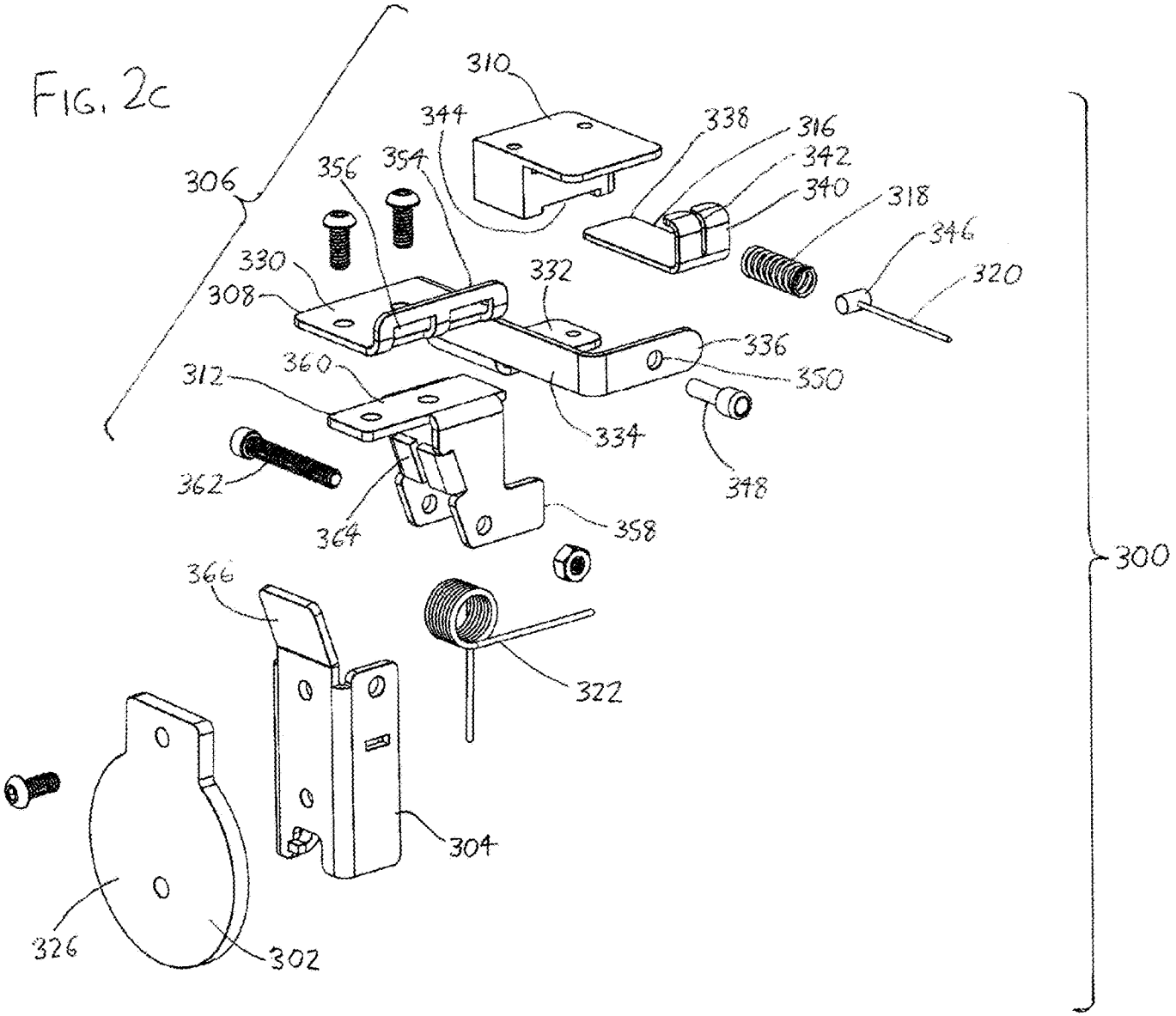
FIG. 2*c* depicts the latching target subassembly 300 of FIGS. 2*a*-2*b* in exploded (disassembled) form.

FIGS. 2*a*-2*g* then illustrate one of the latching target subassemblies 300 in detail, with FIGS. 2*a* and 2*d*-2*g* showing the latching target subassembly 300 mounted on the lower surface of the frame central section 206, and with FIGS. 2*b* and 2*c* omitting the assembly frame 200. The latching target 302 is shown as a plate having a planar front latching target face 326 (FIGS. 2*a*-2*c*) intended for projectile strikes, and an opposing rear latching target face 328 (FIGS. 2*d*-2*g*) connected to the latching target arm 304 (which is pivotally connected to the latching target anchor 306). Looking particularly to FIGS. 2*b* and 2*c*, the latching target anchor 306 includes a bridge unit 308, a catch receiver 310, and a pivot unit 312, with these components being assembled as best seen in FIGS. 2*b* and 2*d*-2*g*. These components will now be discussed in further detail with particular reference to FIG. 2*c*.

The bridge unit 308 includes a bridge pivot mounting plate 330 which has the pivot unit 312 mounted to its bottom (with the assembly frame 200 being sandwiched between the bridge pivot mounting plate 330 and pivot unit 312); a bridge catch mounting plate 332 which has the catch receiver 310 mounted to its top; and an intermediate bridge member 334 therebetween which extends outwardly from the bridge pivot mounting plate 330 and bridge catch mounting plate 332 and bends to define a biasing member 336.

The catch 316, which includes a catch tongue 338 extending from a catch stop 340 having an unlatching member passage 342 defined therein, is slidably received within a channel 344 defined in the bottom of the catch receiver 310. The catch 316 therefore slides between the catch receiver 310 and the bridge catch mounting plate 332, with its catch stop 340 traveling between the catch receiver 310 and the biasing member 336 of the bridge unit 308 (see particularly FIGS. 2*d*-2*g*). To connect to the catch 316, the unlatching member 320 extends from an enlarged catch pull 346 (FIG. 2*c*), through the unlatching member passage 342 in the catch stop 340, then through the catch spring 318, then into an anchor unlatching member sleeve 348 extending into an unlatching member aperture 350 in the biasing member 336, and then into an unlatching member tube 352 (also omitted from FIG. 2*c*) which carries the unlatching member 320 to the reset target subassembly 400. While not shown in the drawings, the catch pull 346, which prevents the unlatching member 320 from being pulled from the catch 316, is preferably removably connectable to the unlatching member 320, as by forming it of a short internally-threaded tube which receives a set screw therein, and having a side aperture along its length into which the unlatching member 320 can be received and then grasped by adjustment of the set screw.

Figure 2D:
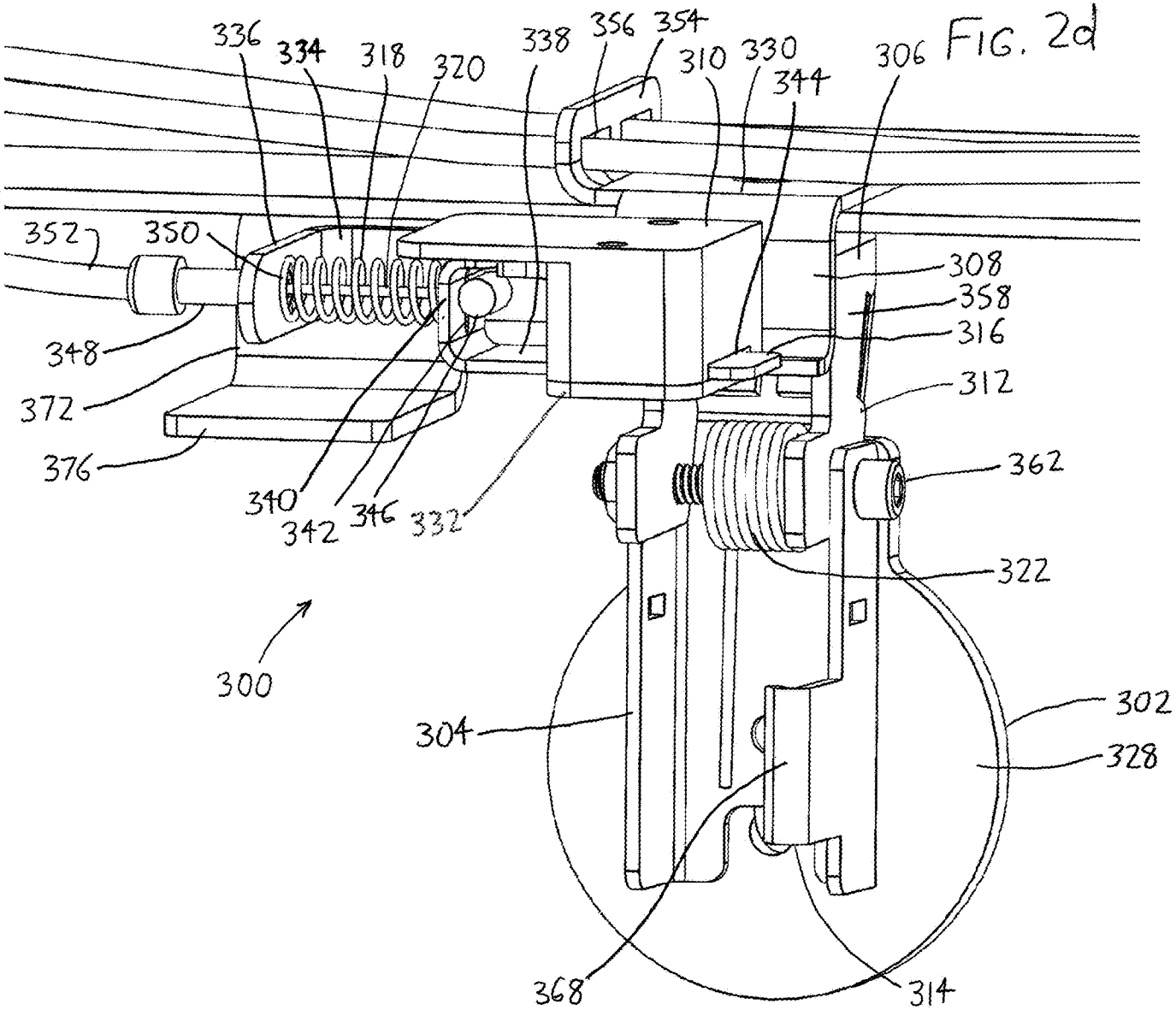
FIG. 2*d* is a rear view of the latching target subassembly 300 of FIGS. 2*a*-2*c*, shown with only a portion of the frame central section 206 to which the subassembly 300 is mounted, with its latching target 302 in its extended latching target position (as in FIGS. 2*a*-2*c*).

The bridge pivot mounting plate 330 includes an upwardly-extending member guide flange 354 with receiving apertures 356 defined therein. These receiving apertures 356 can receive the unlatching members 320 extending to other latching target subassemblies 300 situated about the assembly frame 200, as best seen in FIG. 2*b*. As best seen in FIG. 2*d*, the bridge pivot mounting plate 330 may be fastened atop the rearwardly-extending portion of the channel of the assembly frame 200 such that the member guide flange 354 is situated within the frame channel, whereby unlatching members 320 installed within the receiving apertures 356 are sheltered within the frame channel (see also FIG. 2*b*).

The pivot unit 312 has pivot unit legs 358 extending from opposing sides of a pivot unit mounting plate 360 which connects to the bridge pivot mounting plate 330, with the assembly frame 200 being situated between the pivot unit mounting plate 360 and the bridge pivot mounting plate 330. The pivot unit legs 358 are pivotally affixed to opposing sides of the latching target arm 304 at a target pivot 362 (fastener) in a clevis hinge arrangement (compare FIGS. 2*b* and 2*c*). The latching target spring 322 is situated between the pivot unit 312 and the latching target arm 304 such that the latching target arm 304 (and thus the latching target 302) are biased toward the extended latching target position. The pivot unit legs 358 bear opposing inwardly-extending stops 364 which interfere with a stop plate 366 at the top of the latching target arm 304 when the latching target 302 is in its fully extended latching target position, preventing the latching target spring 322 from extending the latching target 302 forwardly past this position.

Figure 2E:
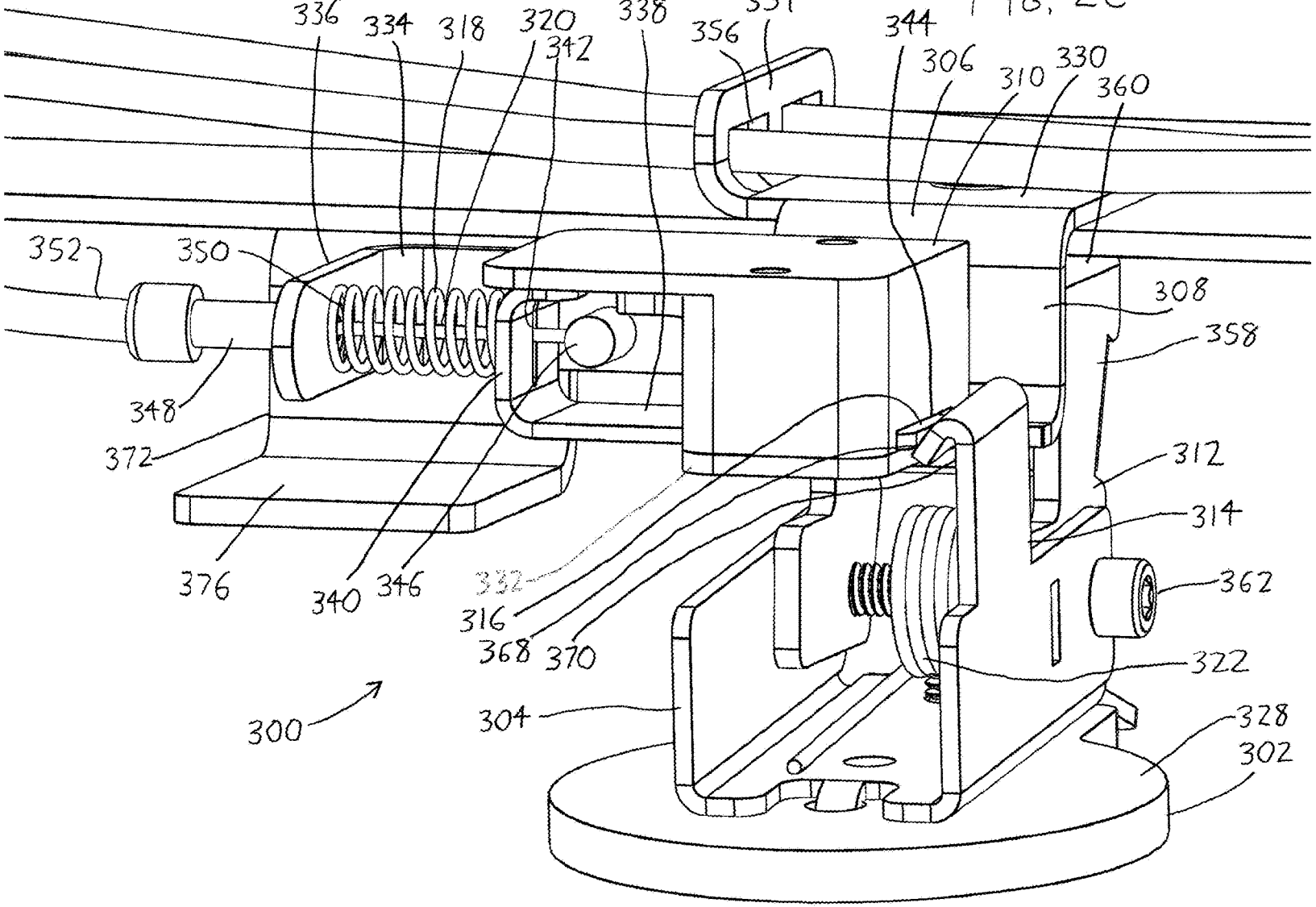
FIG. 2*e* depicts the latching target subassembly 300 of FIG. 2*d* with its latching target 302 deflected from its extended latching target position and approaching its retracted latching target position, with the latch 314 deflecting the catch 316.
Figure 2F:
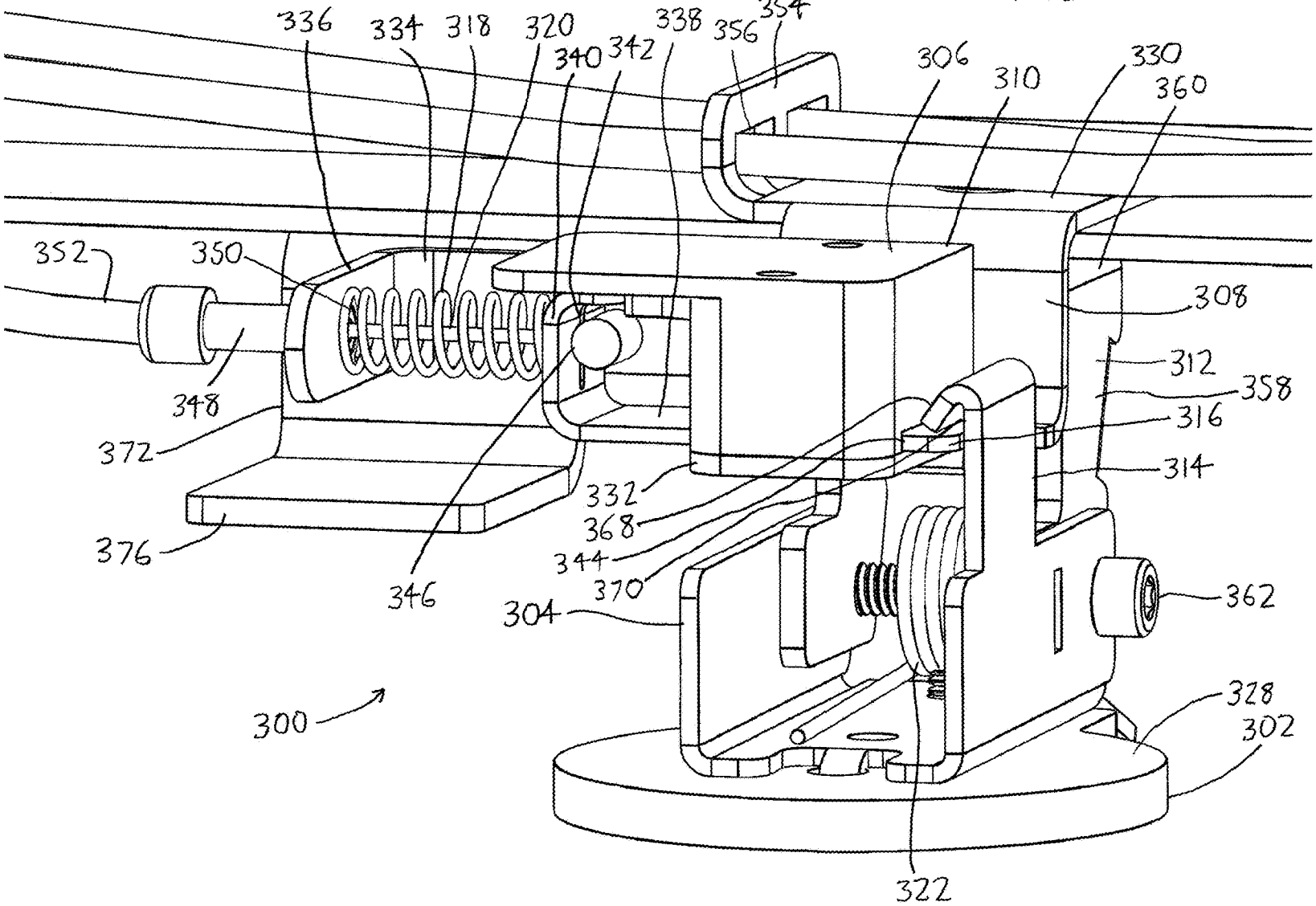
FIG. 2*f* depicts the latching target subassembly 300 of FIG. 2*e* with its latching target 302 fully deflected into its retracted latching target position, with the catch 316 received within the latch 314 and holding the latching target 302 in its retracted latching target position.
Figure 29:
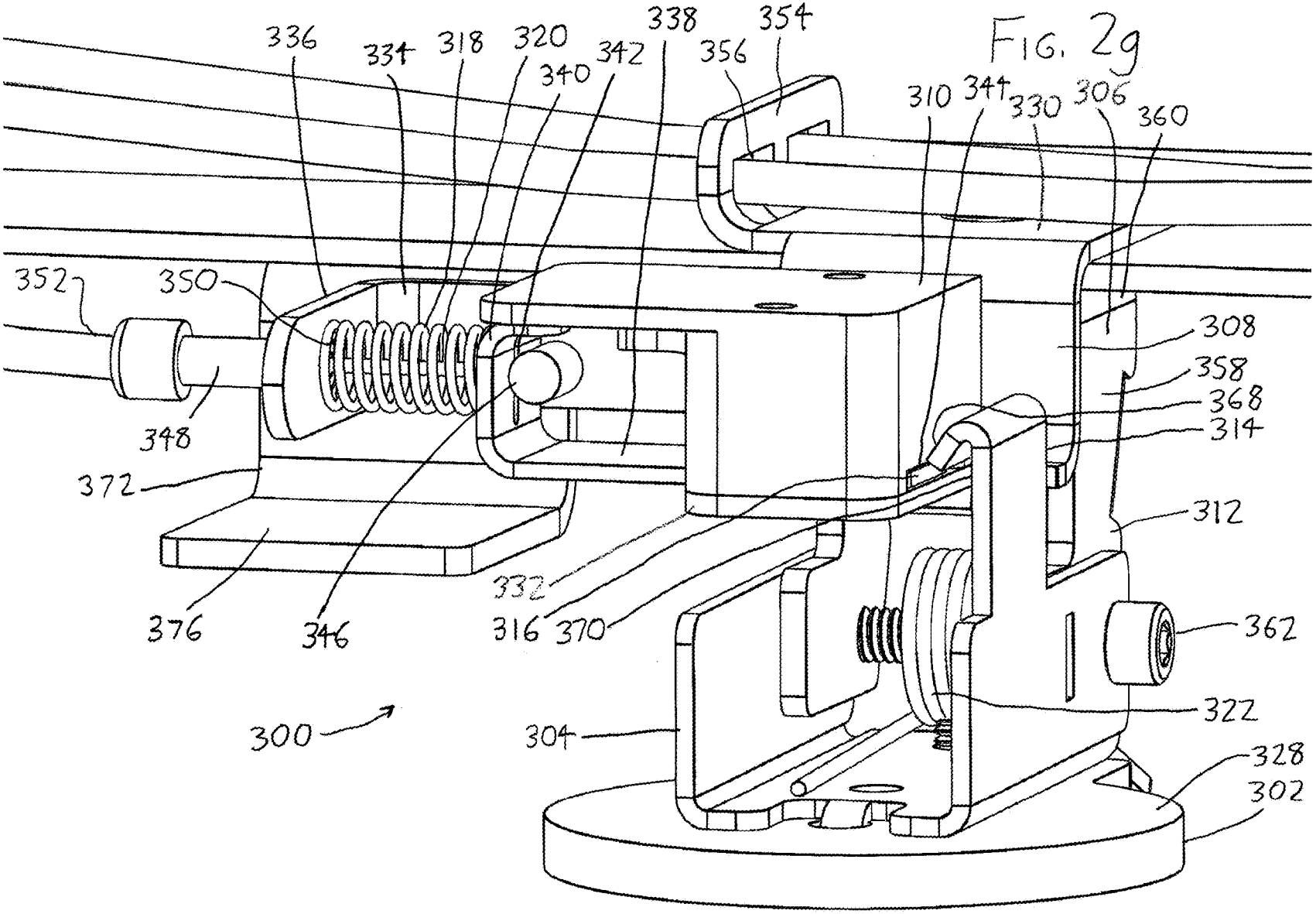

As best seen in FIGS. 2*d*-2*g*, the latch 314 extends rearwardly from the latching target arm 304 (and thus from the rear latching target face 328) to a laterally-protruding angled outer latch face 368 configured to urge the catch 316 from the latch travel path (as seen in FIG. 2*e*) when the latch 314 travels from the extended target position to the retracted target position. An inner latch face 370 is then indented from the outer latch face 368, whereby the catch 316 is elastically biased by the catch spring 318 toward the inner latch face 370 following travel of the outer latch face 368 past the catch 316 (as seen in FIG. 2*f*).

The foregoing components then operate as seen in FIGS. 2*d*-2*g*:

(1) FIG. 2*d*: When the latching target 302 is in its extended latching target position (and the reset target 402 is in its extended reset target position as seen in FIG. 3*c*), the catch 316 is urged by the catch spring 318 such that its catch tongue 338 protrudes from the latching target anchor 306 (more particularly, from the channel 344 defined between the catch receiver 310 and the bridge catch mounting plate 332).

(2) FIG. 2*e*: The latching target 302 has been struck by a projectile, urging it against the force of the latching target spring 322 toward its retracted latching target position, and urging the outer latch face 368 against the catch tongue 338, defeating the biasing of the catch spring 318 to deflect the catch 316. Because the unlatching member 320 passes through the unlatching member passage 342 and catch spring 318, the catch pull 346 and unlatching member 320 do not move with the catch 316.

(3) FIG. 2*f*: The latching target 302 has reached its fully retracted latching target position, with the catch 316 extending within the inner latch face 370. The latch 314 therefore bears against the catch 316 to prevent the latching target spring 322 (and/or the force of gravity) from returning the latching target 302 to its extended latching target position.

(4) FIG. 2*g*: The reset target 402 is struck to deflect it to its retracted reset target position, thereby pulling the unlatching member 320 away from the reset target subassembly 400 (as in FIG. 3*d*). This urges the catch pull 346 against the catch stop 340, defeating the biasing force of the catch spring 318 and pulling the catch tongue 338 from the inner latch face 370. The latch 314 is thereby released from the catch 316, with FIG. 2*g* showing the moment of release.

The latching target spring 322 (and/or the force of gravity) then return the latching target 302 to its extended latching target position (as in FIG. 2*d*). As the reset target 402 returns to its extended reset target position (from FIG. 3*d* to FIG. 3*c*), tension on the unlatching member 320 is relieved, and the catch spring 318 drives the catch stop 340 to push the catch pull 346 away from the biasing member 336, thereby pulling the slack unlatching member 320 from the reset target subassembly 400. At the same time, the catch tongue 338 is driven to protrude from the channel 344 between the catch receiver 310 and the bridge plate, resetting it for subsequent latching.

FIGS. 2*b* and 2*d*-*g* also illustrate a shield 372 which affixes to the assembly frame 200 at a shield mounting plate 374 (FIG. 2*b*), and which has a shield cover 376 which curves about and protects the bridge pivot mounting plate 330, the anchor unlatching member sleeve 348, and associated components from projectile (e.g., puck) strikes.

Figure 3A:
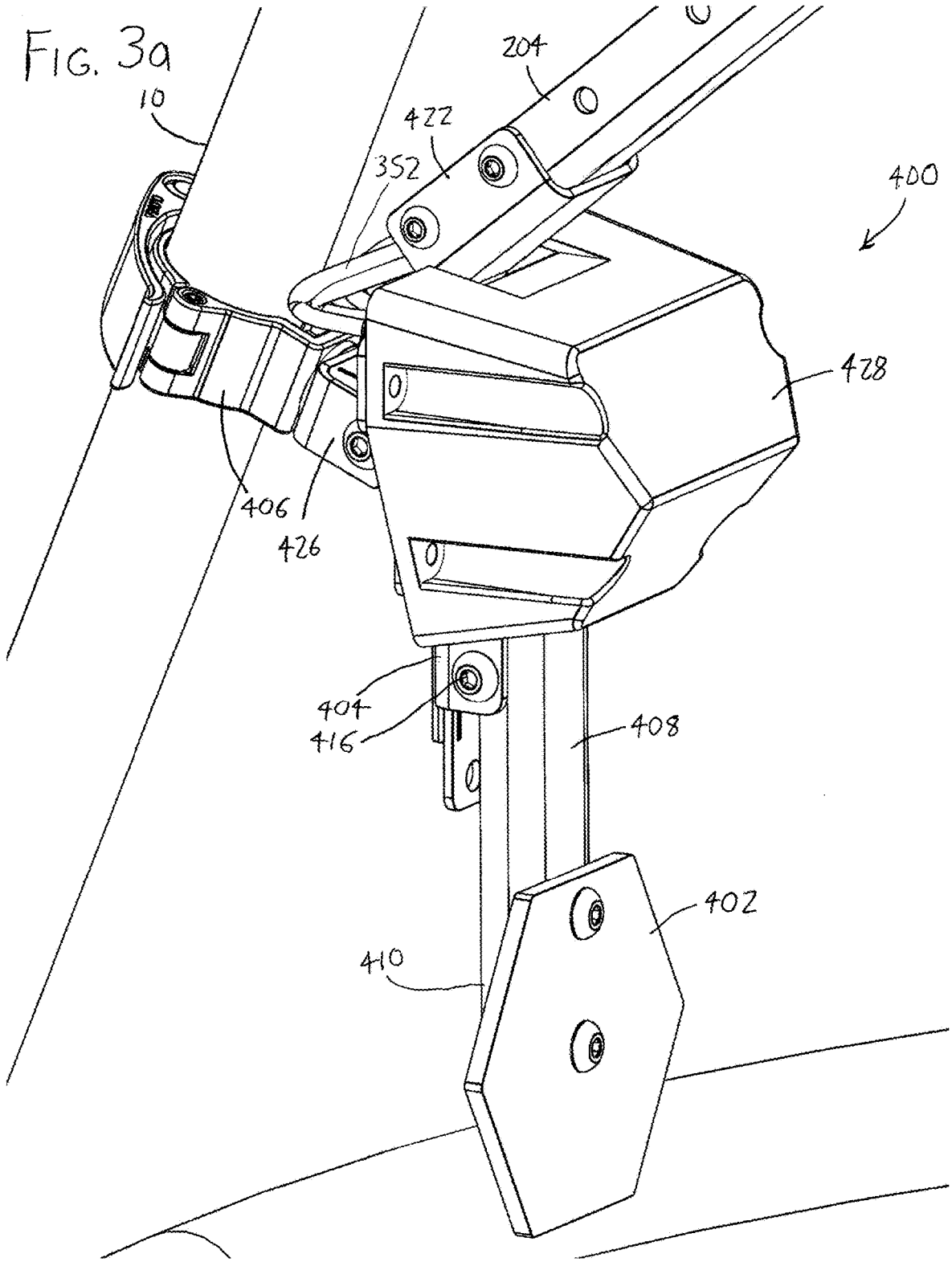
FIG. 3*a* depicts the reset target subassembly 400 of FIGS. 1*a*-1*b* in greater detail.
Figure 3B:
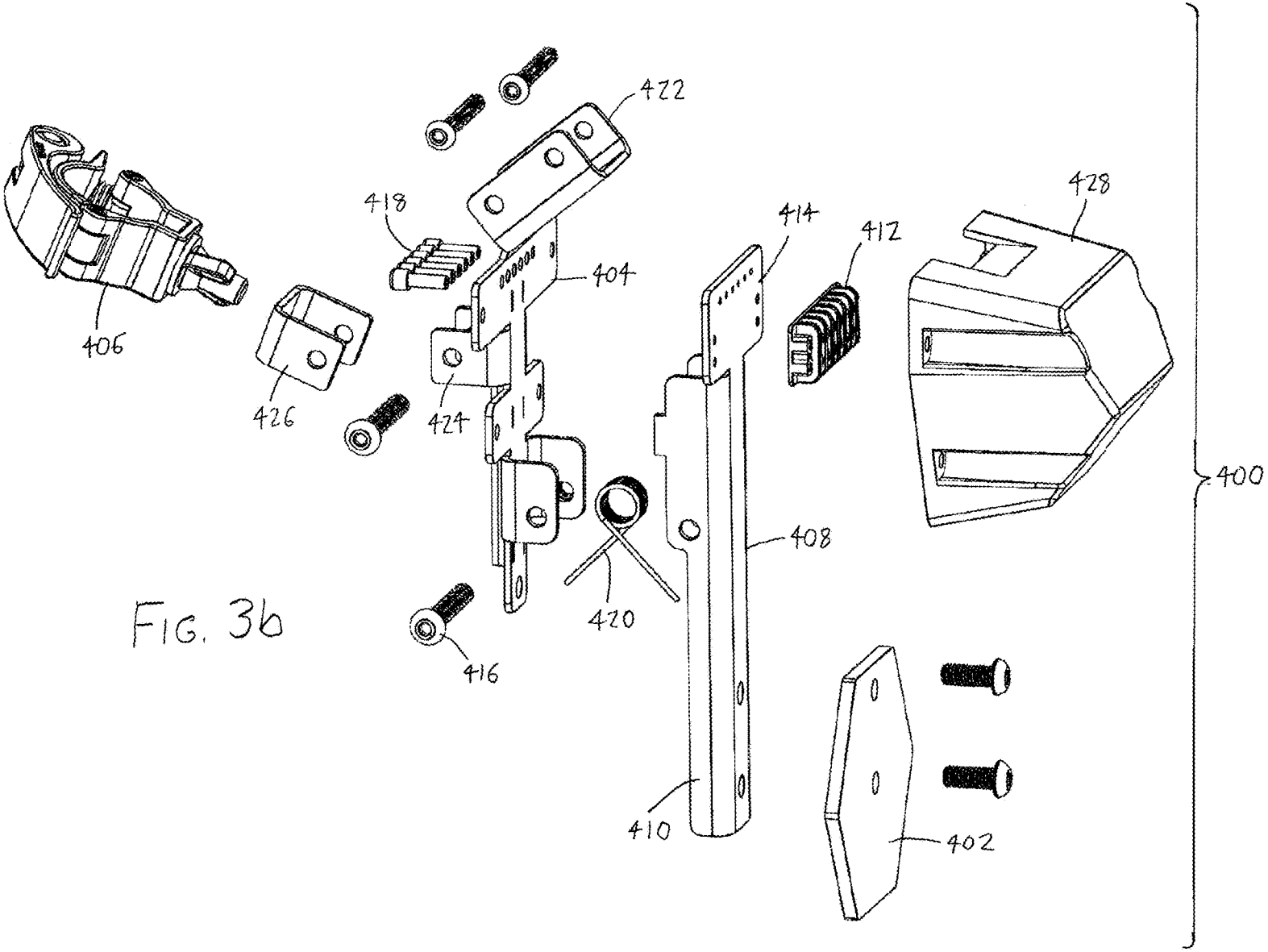
FIG. 3*b* is an exploded (disassembled) view of the reset target subassembly 400.
Figure 3C:
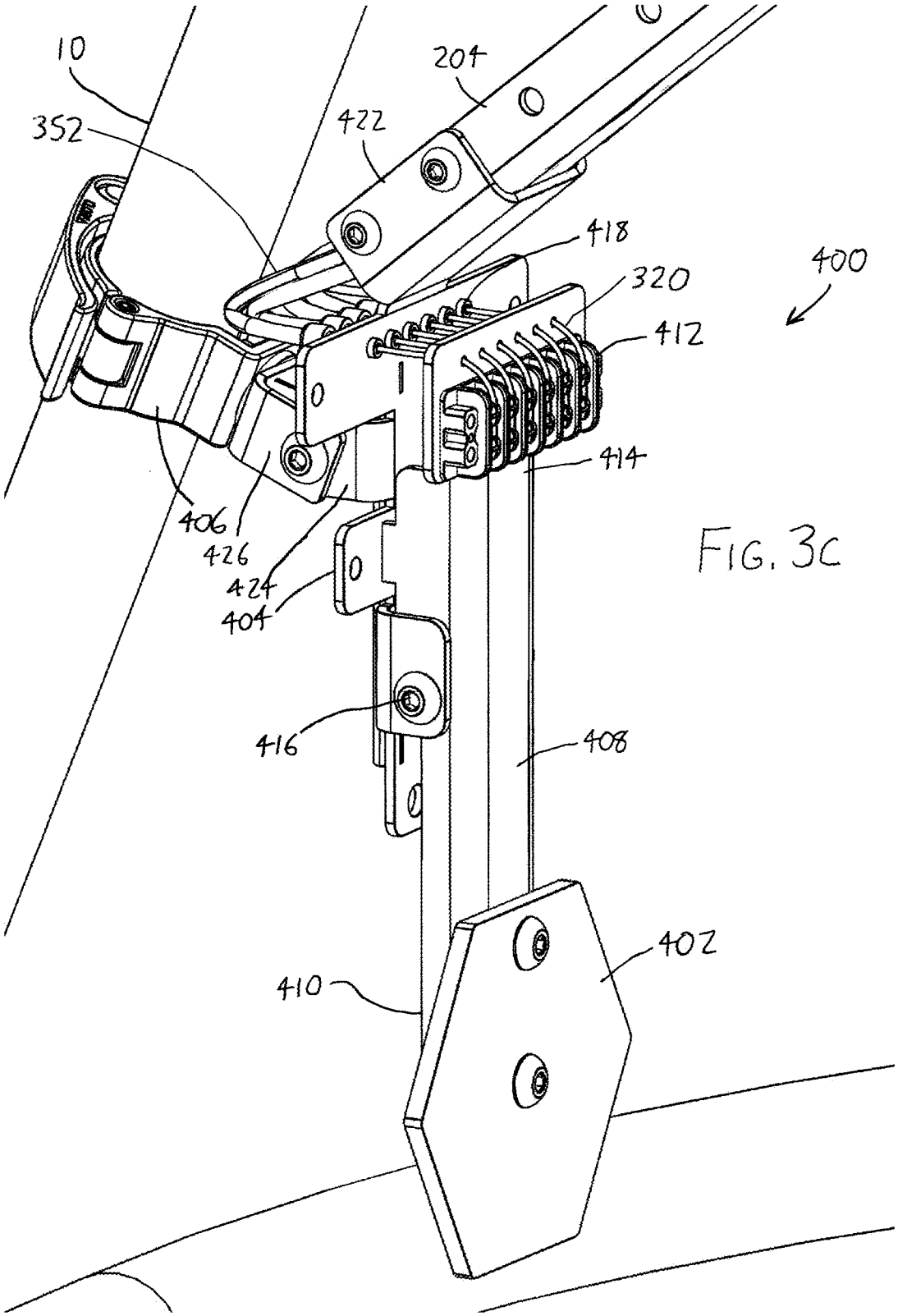
FIG. 3*c* depicts the reset target subassembly 400 of FIG. 3*a* with its reset target cover 428 removed.
Figure 3D:
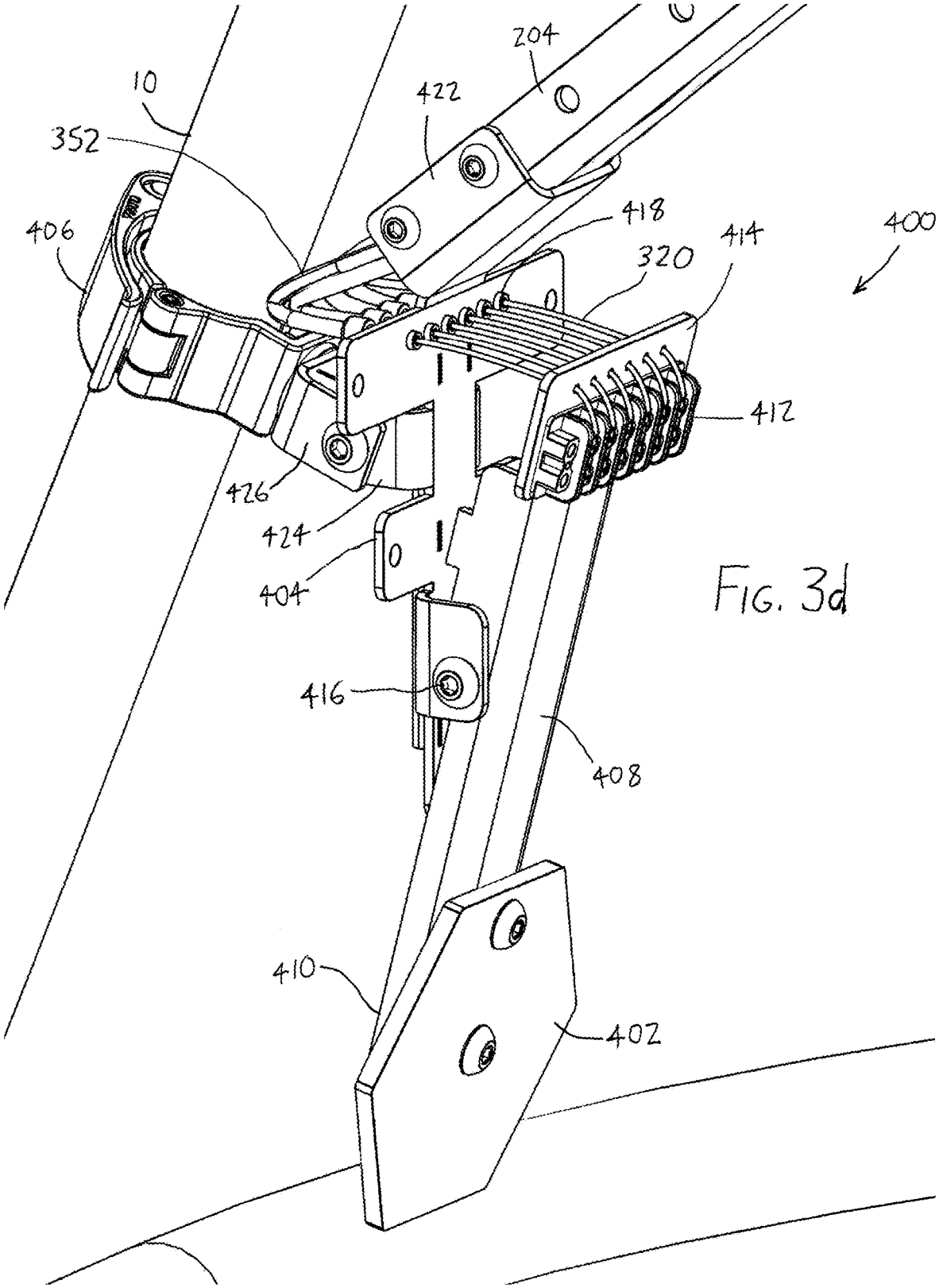
FIG. 3*d* depicts the reset target subassembly 400 of FIG. 3*c* with its reset target 402 deflected from its extended reset target position to its retracted reset target position, thereby pulling the unlatching members 320 from their respective latching target subassemblies 300.

The reset target subassembly 400 is then depicted in detail in FIGS. 3*a*-3*d*, with the reset target 402 being shown in its extended reset target position in FIGS. 3*a*-3*c*, and in its retracted reset target position (as if struck by a puck or other projectile) in FIG. 3*d*. As seen in FIG. 3*a*, when ready to use, the reset latching target subassembly 300 (and the frame leg 204 affixed thereto) is connected to the rear goal support post 14 via the reset target clamp 406. FIG. 3*b* then illustrates the disassembled reset target subassembly 400, showing its reset target 402 detached from the target end 410 of the reset target arm 408. An unlatching member harness 412, to which the unlatching members 320 of the latching target subassemblies 300 are connected, is similarly shown detached from the opposing unlatching member end 414 of the reset target arm 408. The reset target anchor 404, to which the reset target arm 408 is pivotally affixed via pivot pin (fastener) 416, bears reset target unlatching member sleeves 418 which receive the unlatching members 320 from the unlatching member harness 412 (as seen in FIGS. 3*c*-3*d*) with low friction, and assist in guiding them into the channel of the frame leg 204 for routing to the latching target subassemblies 300. A reset target spring 420 is fit between the reset target arm 408 and the reset target anchor 404, and about the pin 416, to assist with biasing the reset target 402 (via its reset target arm 408) into its extended reset target position (to any extent the reset target 402 doesn't move into its extended reset target position via the force of gravity). The reset target anchor 404 further includes a bracket 422 for receipt of (and connection to) the frame leg 204, and a pair of opposing ears 424 are pinned to yoke 426 to provide a clevis-type pivot arrangement. The reset target clamp 406 for releasably securing the reset target anchor 404 to the rear goal support post 14 is then rotatably mounted on the yoke 426. A protective cover 428 shields the unlatching member harness 412 from puck/projectile strikes.

The action of the reset target subassembly 400 is shown in FIGS. 3*c*-3*d*, wherein the cover 428 is removed for clarity. The reset target subassembly 400 rests in its extended reset target position as in FIG. 3*c*, and upon being struck by a puck/projectile, the reset target 402 is knocked into the retracted reset target position of FIG. 3*d*, with the impact defeating the bias exerted by the reset target spring 420. As the unlatching member harness 412 moves in the opposite direction, the unlatching members 320 are pulled by the unlatching member end 414 of the reset target arm 408 through their unlatching member 320 sleeves, and through the tubes 352 carrying the unlatching members 320 to their latching target subassemblies 300, to unlatch any latching targets 302 which are in their retracted latching target positions (with these latching targets 302 then returning to their extended latching target positions as described above). The reset target 402 then returns to the extended reset target position of FIG. 3*c* due to the force of the reset target spring 420 and/or due to gravity. During such return, the unlatching members 320 are at least partially pulled back toward their latching target subassemblies 300 due to the force of the catch spring 318 of FIGS. 2*d*-2*g*, and/or via the unlatching members 320 being pushed by the unlatching member end 414 of the reset target arm 408 (assuming the unlatching members 320 have sufficient stiffness).

The version of the invention described above and shown in the accompanying drawings is merely exemplary, and numerous modifications are possible. Exemplary modifications follow.

The projectile target assembly 100 can be used for any suitable form of target practice, not merely for hockey target practice. As other examples, the assembly could situate latching and reset target subassemblies 300 and 400 about a baseball strike zone for baseball pitching practice, about a field for football throwing accuracy practice, about a soccer goal zone for soccer practice, about a disc golf target for disc golf practice, and so forth. Targets may take any suitable dimensions and form, e.g., as plates, nets/meshes, fabric or other sheet material with a supporting frame, etc.

The unlatching members 320 are preferably formed of inelastic (but flexible) cables, e.g., cables formed of metal or other strands which are braided or woven, and preferably have their lengths sheathed within unlatching member tubes 352 (see, e.g., FIG. 2*d*) which provide less friction/resistance for the unlatching members 320 as they move. However, unlatching members can take other forms, such as textile cords, linkages (e.g., chains or pivotally-linked rods/beams), or in alternative versions of the invention where the unlatching members 320 need not bend, rigid members such as rods/beams.

The projectile target assembly 100 need not be supported by structure such as a hockey goal 10, and could simply utilize a assembly frame 200 which wholly self-supports the latching and reset target subassemblies 300 and 400. Alternatively, the assembly frame 200 need not be included, and latching and reset target subassemblies 400 and 400 may simply be clamped or otherwise connected to structure(s) in the environment in which the projectile target assembly 100 is to be used. Connection to nearby structure(s) is also not necessary if, for example, the latching and reset target subassemblies 300 and 400 are provided with weighted bases.

The latching and reset target subassemblies 300 and 400 may each take a variety of forms different from those shown. As an example, a latching target subassembly 300 might be provided with a reset target subassembly 400 in the form of a pull cord (i.e., the latching target 302 may be extended by simply pulling a pull cord coupled to the unlatching member 320 of the latching target subassembly 300). As other examples, targets 302 and/or 402 may pivot downwardly rather than upwardly or to the side, and may translate instead of (or in addition to) pivoting.

It should be understood that various terms referring to orientation and position used throughout this document—e.g., "upward," "downward," "top," "bottom," "right," "left," etc.—are relative terms rather than absolute ones. In other words, it should be understood (for example) that a feature noted as being at the "bottom" may in fact be located at the top of the assembly depending on the overall orientation of the assembly. Thus, such terms should be regarded as words of convenience, rather than limiting terms.

When one part is said to be "fixed" or "affixed" to another part, this indicates that the parts are attached in immovable relationship to each other (either directly or via an intervening component), whereas the terms "coupled" or "connected" more broadly indicate that the parts may be somehow attached as a unit (either directly or via an intervening component), though one part may move with respect to the other, or that the parts may be fixed. If parts are said to be irremovably "fixed," "affixed," "coupled," or "connected," this indicates that the parts require destructive detachment, as by cutting them apart. Conversely, if parts are said to be removably "fixed," "affixed," "coupled," or "connected," this indicates that the parts are intended (and constructed) for rapid separation by hand, or by use of simple tools such as a screwdriver or pliers.

The versions of the invention described above are merely exemplary, and the invention is not intended to be limited to these versions. Rather, the scope of rights to the invention is limited only by the claims set out below, and the invention encompasses all different versions that fall literally or equivalently within the scope of these claims. In these claims, no element therein should be interpreted as a "means-plus-function" element or a "step-plus-function" element pursuant to 35 U.S.C. § 112 (f) unless the words "means for" or "step for" are explicitly used in the particular element in question.

What is claimed is:

1. A projectile target assembly including a latching target subassembly having:

a. a latching target anchor, b. a latching target:

(1) movably connected to the latching target anchor to move between an extended latching target position and a retracted latching target position, (2) having a latch connected thereto, wherein the latch travels along a latch travel path when the latching target moves between the extended and retracted latching target positions, c. a catch:

(1) connected to the latching target anchor, (2) movable with respect to the latching target anchor, (3) elastically biased into the latch travel path, wherein the latch engages the catch when the latch travels along the latch travel path from the extended latching target position to the retracted latching target position, d. an unlatching member connected to the catch, wherein moving the unlatching member from the latching target anchor moves the catch from the latch travel path, thereby disengaging the latch from the catch.

2. The projectile target assembly of claim 1 wherein the latching target is elastically biased with respect to the latching target anchor toward the extended latching target position.

3. The projectile target assembly of claim 1 wherein:

a. the latching target pivots with respect to the latching target anchor about a target pivot axis to move between the extended and retracted latching target positions, b. the catch is defined by an elongated member which is elastically biased to translate along an axis parallel to the target pivot axis into the latch travel path.

4. The projectile target assembly of claim 1 wherein:

a. the latching target has:

(1) a front target face extending across a plane, and (2) an opposing rear target face, b. the latch:

(1) extends from the rear target face, (2) includes:

(a) an outer latch face configured to deflect the catch, and (b) an inner latch face configured to receive the catch therein, when the latch travels along the latch travel path.

5. The projectile target assembly of claim 1 wherein:

a. the latching target:

(1) has:

(a) a front target face extending across a plane, and (b) an opposing rear target face, (2) pivots about a target pivot axis with respect to the latching target anchor to move between the extended and retracted latching target positions, b. the latch:

(1) extends from the rear target face, (2) includes:

(a) an outer latch face angled to urge the catch from the latch travel path when the latch travels from the extended latching target position to the retracted latching target position, and (b) an inner latch face indented from the outer latch face, whereby the catch is elastically biased toward the inner latch face following travel of the outer latch face past the catch.

6. The projectile target assembly of claim 1 wherein the unlatching member:

a. is unaffixed to the catch, and b. extends adjacent the catch to a catch pull, wherein moving the unlatching member from the latching target anchor urges the catch pull against the catch to move the catch from the latch travel path.

7. The projectile target assembly of claim 1 wherein the unlatching member extends:

a. through a passage in the catch, and b. between:

(1) a catch pull adjacent the anchor, and (2) a target reset subassembly configured to move the unlatching member with respect to the latching target anchor, whereby moving the unlatching member from the latching target anchor urges the catch pull against the catch to move the catch from the latch travel path.

8. The projectile target assembly of claim 7 wherein the unlatching member is translatable through the passage in the catch.

9. The projectile target assembly of claim 7:

a. further including a spring extending between the anchor and the catch, the spring elastically biasing the catch into the latch travel path, b. wherein the unlatching member extends through the spring.

10. The projectile target assembly of claim 1 further including a target reset subassembly having:

a. a reset target anchor, b. a reset target:

(1) movably connected to the reset target anchor, (2) connected to the unlatching member, wherein moving the reset target with respect to the reset target anchor moves the unlatching member from the latching target anchor, thereby moving the catch from the latch travel path and disengaging the latch from the catch.

11. The projectile target assembly of claim 1 wherein:

a. the projectile target assembly includes two or more of the latching target subassembly, and b. the reset target is connected to the unlatching member of each latching target subassembly.

12. The projectile target assembly of claim 11:

a. further including a frame defining an arch, and b. wherein the arch bears the latching target subassemblies thereon, with the latching targets extending into the interior of the arch.

13. The projectile target assembly of claim 10 wherein:

a. the latching target anchor subassembly and reset target anchor subassembly are mounted on a frame, and b. the unlatching member is defined by a cable extending along the frame.

14. The projectile target assembly of claim 1 further including a target clamp:

a. connected to the latching target anchor, and b. configured to releasably engage an object distinct from the projectile target assembly.

15. A projectile target assembly including a latching target subassembly having:

a. a latching target anchor, b. a catch elastically biased to protrude from the latching target anchor, c. a latching target:

(1) pivotable with respect to the latching target anchor, (2) having a latch connected thereto, wherein the latch:

(a) travels along a latch travel path, and (b) into engagement with the catch, when the latching target pivots with respect to the latching target anchor, d. an unlatching member connected to the catch, wherein moving the unlatching member from the latching target anchor disengages the latch from the catch.

16. The projectile target assembly of claim 15 further including a reset target:

a. having the unlatching member connected thereto, and b. pivotally connected to a reset target anchor, wherein pivoting of the reset target with respect to the reset target anchor moves the unlatching member from the latching target anchor, thereby disengaging the latch from the catch.

17. A projectile target assembly including:

a. a latching target subassembly having:

(1) a latching target anchor, (2) a latching target:

(a) pivotable with respect to the latching target anchor between an extended latching target position and a retracted latching target position, (b) having a latch connected thereto, wherein the latch travels along a latch travel path when the latching target moves between the extended and retracted latching target positions, (3) a catch elastically biased into the latch travel path, wherein the latch engages the catch when the latch travels along the latch travel path from the extended latching target position to the retracted latching target position, b. a target reset subassembly having:

(1) a reset target anchor, (2) a reset target pivotable with respect to the reset target anchor between an extended reset target position and a retracted reset target position, c. an unlatching member extending between the catch and the reset target, wherein moving the reset target from the extended reset target position toward the retracted reset target position urges the catch from the latch travel path via the unlatching member, thereby moving the catch from the latch travel path and disengaging the latch from the catch.

18. The projectile target assembly of claim 17 wherein:

a. the latching target anchor subassembly and reset target anchor subassembly are mounted on a frame, and b. the unlatching member is defined by a cable.

19. The projectile target assembly of claim 17 wherein the unlatching member extends from the reset target through a passage in the catch to a catch pull adjacent the catch, wherein moving the reset target from the extended reset target position toward the retracted reset target position urges the catch pull against the catch, thereby urging the catch from the latch travel path.

20. The projectile target assembly of claim 19:

a. further including a spring elastically biasing the catch into the latch travel path, b. wherein the unlatching member extends through the spring.

21. The projectile target assembly of claim 1 wherein the catch is provided on the latching target anchor.

22. The projectile target assembly of claim 15 wherein the catch is provided on the latching target anchor.

23. The projectile target assembly of claim 17 wherein the catch is provided on the latching target anchor.

* * * * *